US009870841B2

(12) United States Patent
Yoshida et al.

(10) Patent No.: US 9,870,841 B2
(45) Date of Patent: Jan. 16, 2018

(54) ALUMINUM ALLOY WIRE ROD, ALUMINUM ALLOY STRANDED WIRE, COATED WIRE, WIRE HARNESS AND MANUFACTURING METHOD OF ALUMINUM ALLOY WIRE ROD

(71) Applicants: FURUKAWA ELECTRIC CO., LTD., Tokyo (JP); FURUKAWA AUTOMOTIVE SYSTEMS INC., Shiga (JP)

(72) Inventors: Sho Yoshida, Tokyo (JP); Shigeki Sekiya, Tokyo (JP); Kengo Mitose, Tokyo (JP)

(73) Assignees: FURUKAWA ELECTRIC CO., LTD., Tokyo (JP); FURUKAWA AUTOMOTIVE SYSTEMS INC., Inukami-Gun, Shiga (JP)

( * ) Notice: Subject to any disclaimer, the term of this patent is extended or adjusted under 35 U.S.C. 154(b) by 0 days.

(21) Appl. No.: 15/464,828

(22) Filed: Mar. 21, 2017

(65) Prior Publication Data

US 2017/0194067 A1 Jul. 6, 2017

Related U.S. Application Data

(63) Continuation of application No. PCT/JP2015/076745, filed on Sep. 18, 2015.

(30) Foreign Application Priority Data

Sep. 22, 2014 (JP) ..... 2014-193105

(51) Int. Cl.
*H01B 1/02* (2006.01)
*C22C 21/08* (2006.01)
(Continued)

(52) U.S. Cl.
CPC ..... *H01B 1/023* (2013.01); *B21C 1/02* (2013.01); *C22C 21/02* (2013.01); *C22C 21/08* (2013.01);
(Continued)

(58) Field of Classification Search
USPC ..... 428/372; 174/74 R
See application file for complete search history.

(56) References Cited

U.S. PATENT DOCUMENTS 8,679,641 B2 * 3/2014 Saxton ..... B22F 7/08 419/10
9,263,167 B2 * 2/2016 Yoshida ..... C22C 21/02
(Continued)

FOREIGN PATENT DOCUMENTS

JP 5367926 B1 12/2013
WO WO 2011/052644 A1 5/2011
(Continued)

OTHER PUBLICATIONS

International Preliminary Report on Patentability and Written Opinion of the International Searching Authority (forms PCT/IB/373, PCT/ISA/237 and PCT/IB/326), dated Apr. 6, 2017, for International Application No. PCT/JP2015/076745, with an English translation of the Written Opinion.
(Continued)

*Primary Examiner* — William H Mayo, III
*Assistant Examiner* — Krystal Robinson
(74) *Attorney, Agent, or Firm* — Birch, Stewart, Kolasch & Birch, LLP

(57) ABSTRACT

An aluminum alloy wire rod has a composition including 0.1-1.0 mass % Mg; 0.1-1.0 mass % Si; 0.01-1.40 mass % Fe; 0.000-0.100 mass % Ti; 0.000-0.030 mass % B; 0.00-1.00 mass % Cu; 0.00-0.50 mass % Ag; 0.00-0.50 mass % Au; 0.00-1.00 mass % Mn; 0.00-1.00 mass % Cr; 0.00-0.50
(Continued)

mass % Zr; 0.00-0.50 mass % Hf; 0.00-0.50 mass % V; 0.00-0.50 mass % Sc; 0.00-0.50 mass % Sn; 0.00-0.50 mass % Co; 0.00-0.50 mass % Ni; and the balance being Al and inevitable impurities, and an area fraction of a region in which an angle formed by a longitudinal direction of the aluminum alloy wire rod and a <111> direction of a crystal is within 20° is greater than or equal to 20% and less than or equal to 65%.

9 Claims, 1 Drawing Sheet

(51) Int. Cl.

| | |
|---|---|
| ***C22C 21/02*** | (2006.01) |
| ***C22F 1/047*** | (2006.01) |
| ***C22F 1/043*** | (2006.01) |
| ***H01B 5/02*** | (2006.01) |
| ***H01B 5/08*** | (2006.01) |
| ***H01B 7/02*** | (2006.01) |
| ***H01B 7/00*** | (2006.01) |
| ***H01B 13/00*** | (2006.01) |
| ***B21C 1/02*** | (2006.01) |

(52) U.S. Cl.

CPC ..... *C22F 1/043* (2013.01); *C22F 1/047* (2013.01); *H01B 5/02* (2013.01); *H01B 5/08* (2013.01); *H01B 7/0045* (2013.01); *H01B 7/02* (2013.01); *H01B 13/0016* (2013.01)

(56) References Cited

U.S. PATENT DOCUMENTS

| | | | | |
|---|---|---|---|---|
| 9,263,168 | B2 * | 2/2016 | Sekiya | C22C 21/02 |
| 9,422,612 | B2 * | 8/2016 | Kusakari | C22C 21/02 |
| 2006/0013719 | A1 * | 1/2006 | Ichikawa | C22C 21/10 419/29 |
| 2012/0217060 | A1 | 8/2012 | Kusakari et al. | |
| 2013/0126051 | A1 | 5/2013 | Sekiya et al. | |
| 2013/0264115 | A1 | 10/2013 | Kobayashi et al. | |
| 2014/0020796 | A1 | 1/2014 | Sekiya et al. | |
| 2015/0007910 | A1 | 1/2015 | Sekiya et al. | |

FOREIGN PATENT DOCUMENTS

| | | | |
|---|---|---|---|
| WO | WO 2012/008588 | A1 | 1/2012 |
| WO | WO 2012/133634 | A1 | 10/2012 |
| WO | WO 2012/141041 | A1 | 10/2012 |
| WO | WO 2013/147270 | A1 | 10/2013 |

OTHER PUBLICATIONS

International Search Report for PCT/JP2015/076745 (PCT/ISA/210) dated Dec. 28, 2015.

Written Opinion of the International Searching Authority for PCT/JP2015/076745 (PCT/ISA/237) dated Dec. 28, 2015.

* cited by examiner

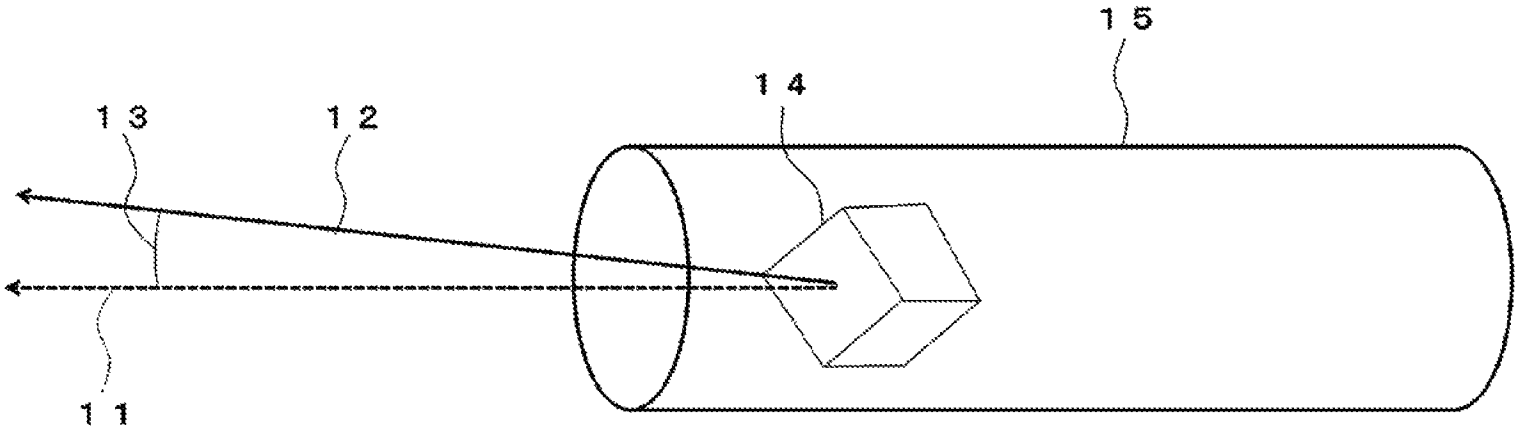
15
14
12
13
11

ALUMINUM ALLOY WIRE ROD, ALUMINUM ALLOY STRANDED WIRE, COATED WIRE, WIRE HARNESS AND MANUFACTURING METHOD OF ALUMINUM ALLOY WIRE ROD

CROSS REFERENCE TO RELATED APPLICATIONS

This is a continuation application of International Patent Application No. PCT/JP2015/076745 filed Sep. 18, 2015, which claims the benefit of Japanese Patent Application No. 2014-193105, filed Sep. 22, 2014, the full contents of all of which are hereby incorporated by reference in their entirety.

BACKGROUND

Technical Field

The present disclosure relates to an aluminum alloy wire rod used as a wire rod of an electric wiring structure, an aluminum alloy stranded wire, a coated wire, a wire harness, and a method of manufacturing an aluminum alloy wire rod.

Background

In the related art, a so-called wire harness has been used as an electric wiring structure for transportation vehicles such as automobiles, trains, and aircrafts, or an electric wiring structure for industrial robots. The wire harness is a member including electric wires each having a wire rod made of copper or copper alloy and fitted with terminals (connectors) made of copper or copper alloy (e.g., brass). With recent rapid advancements in performances and functions of automobiles, various electrical devices and control devices installed in vehicles tend to increase in number and electric wiring structures used for devices also tends to increase in number. On the other hand, for environmental friendliness, lightweighting of transportation vehicles is strongly desired for improving fuel efficiency of transportation vehicles such as automobiles.

As one of the measures for achieving lightweighting of transportation vehicles, there have been, for example, continuous efforts in the studies of using aluminum or aluminum alloys as a wire rod of an electric wiring structure, which is more lightweight, instead of conventionally used copper or copper alloys. Since aluminum has a specific gravity of about one-third of a specific gravity of copper and has a conductivity of about two-thirds of a conductivity of copper (in a case where pure copper is a standard for 100% IACS, pure aluminum has approximately 66% IACS), an aluminum conductor to have a cross sectional area of approximately 1.5 times greater than that of a copper conductor to allow the same electric current as the electric current flowing through the copper conductor to flow through the aluminum conductor. Even an aluminum conductor having an increased cross section as described above is used, using an aluminum conductor is advantageous from the viewpoint of lightweighting, since an aluminum conductor has a mass of about half the mass of a pure copper conductor. Note that, "% IACS" represents a conductivity when a resistivity $1.7241\times10^{-8}$ Ωm of International Annealed Copper Standard is taken as 100% IACS.

However, it is known that pure aluminum wire rods, typically an aluminum alloy wire rod for transmission lines (JIS (Japanese Industrial Standard) A1060 and A1070), is generally poor in its durability to tension, resistance to impact, and bending characteristics. Therefore, for example, it cannot withstand a load abruptly applied by an operator or an industrial device while being installed to a car body, a tension at a crimp portion of a connecting portion between an electric wire and a terminal, and a cyclic stress loaded at a bending portion such as a door portion. On the other hand, an alloyed material containing various additive elements added thereto is capable of achieving an increased tensile strength, but a conductivity may decrease due to a solution phenomenon of the additive elements into aluminum, and because of excessive intermetallic compounds formed in aluminum, a wire break due to the intermetallic compounds may occur during wire drawing. Therefore, it is essential to limit or select additive elements to provide sufficient elongation characteristics to prevent a wire break, and it is further necessary to improve impact resistance and bending characteristics while ensuring a conductivity and a tensile strength equivalent to those in the related art.

For example, aluminum alloy wire rods containing Mg and Si are known as strength aluminum alloy wire rods having characteristics mentioned above. A typical example of this aluminum alloy wire rod is a 6xxx series aluminum alloy (Al—Mg—Si based alloy) wire rod. Generally, the strength of the 6xxx series aluminum alloy wire rod can be increased by applying a solution heat treatment and an aging treatment.

For example, Japanese Patent No. 5367926 discloses a conventional 6xxx series aluminum alloy wire used for an electric wiring structure of the transportation vehicle. An aluminum alloy wire disclosed in Japanese Patent No. 5367926 provides an aluminum alloy wire that is excellent in bending fatigue resistance, tensile strength and conductivity.

However, when attaching a wire harness to a vehicle, the wire harness is bent into a wavy shape at a plurality of points to conform to the layout and installation. Thus, the higher the strength, the more the force is required for bending, and it becomes a burden on workers. Also, it may be bent to nearly 180°, and a wire break may occur at such a part where a severe bending is required. Thus, there is a need for a flexible aluminum electric wire that a high strength usable for a small-sized wire and can be bent by a minimum force. However, with the conventional embodiment such as Japanese Patent No. 5367926, it was not possible to sufficiently meet such a need.

The present disclosure is related to providing an aluminum alloy wire rod used as a wire rod of an electric wiring structure that is usable for a small-sized wire due to a high strength and that has flexibility and can be bent with a reduced force, and also less likely to cause a wire break even if a severe bend such as 180° is applied, an aluminum alloy stranded wire, a coated wire, a wire harness, and a method of manufacturing an aluminum alloy wire rod.

The inventors carried out various studies, and found that an aluminum alloy wire rod having flexibility while maintaining an excellent tensile strength can be manufactured by controlling heat treatment conditions in an aluminum alloy wire rod manufacturing process to control crystal orientation, and obtained the present disclosure based on such findings.

SUMMARY

According to a first aspect of the present disclosure, an aluminum alloy wire rod having a composition comprising or consisting of 0.1 mass % to 1.0 mass % Mg; 0.1 mass % to 1.0 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Sn; 0.00 mass % to 0.50 mass % Co; 0.00 mass % to 0.50 mass % Ni; and the balance being Al and inevitable impurities, wherein an area fraction of a region in which an angle formed by a longitudinal direction of the aluminum alloy wire rod and a <111> direction of a crystal is within 20° is greater than or equal to 20% and less than or equal to 65%.

According to a second aspect of the present disclosure, a method of manufacturing an aluminum alloy wire rod having a composition includes 0.1 mass % to 1.0 mass % Mg; 0.1 mass % to 1.0 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Sn; 0.00 mass % to 0.50 mass % Co; 0.00 mass % to 0.50 mass % Ni; and the balance being Al and inevitable impurities, an area fraction of a region in which an angle formed by a longitudinal direction of the aluminum alloy wire rod and a <111> direction of a crystal is within 20° being greater than or equal to 20% and less than or equal to 65%, the method including forming a drawing stock through hot working subsequent to melting and casting, and thereafter carrying out processes at least including a first heat treatment process, a wire drawing process, a solution heat treatment, and an aging heat treatment process in this order, wherein the first heat treatment process includes, after heating to a predetermined temperature within a range of 480° C. to 620° C., cooling at an average cooling rate of greater than or equal to 10° C./s at least to a temperature of 200° C.

According to the present disclosure, with the configuration described above, it is possible to provide an aluminum alloy wire rod usable for a small-sized wire due to a high strength and that has flexibility and can be bent with a reduced force, and also less likely to cause a wire break even if a severe bend such as 180° is applied, an aluminum alloy stranded wire, a coated wire, a wire harness, and a method of manufacturing an aluminum alloy wire rod. The present disclosure as described above is useful as a battery cable, a harness, or a conducting wire for a motor, equipped on a transportation vehicle, and as a wiring structure of an industrial robot. Further, since an aluminum alloy wire rod of the present disclosure has a high tensile strength, a wire size thereof can be made smaller than that of the wire of the related art, and it can be appropriately used for a cable routing portion that requires a high bending property.

BRIEF DESCRIPTION OF DRAWINGS

FIG. 1 is a schematic diagram for explaining an angle formed by a longitudinal direction of the aluminum alloy wire rod and a <111> direction of a crystal is within 20° according to an embodiment of the present disclosure.

DETAILED DESCRIPTION

Further features of the present disclosure will become apparent from the following detailed description of exemplary embodiments with reference to the accompanying drawings.

An aluminum alloy wire rod according to an embodiment of the present disclosure (hereinafter referred to as a present embodiment) has a composition comprising or consisting of 0.1 mass % to 1.0 mass % Mg; 0.1 mass % to 1.0 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Sn; 0.00 mass % to 0.50 mass % Co; 0.00 mass % to 0.50 mass % Ni; and the balance being Al and inevitable impurities. Also, with the aluminum alloy wire rod according to the present embodiment, an area fraction of a region in which an angle formed by a longitudinal direction of the aluminum alloy wire rod and a <111> direction of a crystal is within 20° is greater than or equal to 20% and less than or equal to 65%.

Hereinafter, reasons for limiting chemical compositions or the like of the aluminum alloy wire rod of the present embodiment will be described.

(1) Chemical Composition

<Mg: 0.10 Mass % to 1.00 Mass %>

Mg (magnesium) is an element having a strengthening effect by forming a solid solution with an aluminum base material and a part thereof having an effect of improving a tensile strength by being combined with Si to form precipitates. However, in a case where Mg content is less than 0.10 mass %, the above effects are insufficient. In a case where Mg content exceeds 1.00 mass %, conductivity also decreases. Accordingly, the Mg content is 0.10 mass % to 1.00 mass %. The Mg content is, when a high strength is of importance, preferably 0.50 mass % to 1.00 mass %, and in case where a conductivity is of importance, preferably 0.10 mass % to 0.50 mass %. Based on the points described above, 0.30 mass % to 0.70 mass % is generally preferable.

<Si: 0.10 Mass % to 1.00 Mass %>

Si (silicon) is an element that has an effect of improving a tensile strength by being combined with Mg to form precipitates. However, in a case where Si content is less than 0.10 mass %, the above effects are insufficient. In a case where Si content exceeds 1.00 mass %, conductivity also decreases. Accordingly, the Si content is 0.10 mass % to 1.00 mass %. The Si content is, when a high strength is of importance, preferably 0.50 mass % to 1.00 mass %, and in case where a conductivity is of importance, preferably 0.10 mass % to 0.50 mass %. Based on the points described above, 0.30 mass % to 0.70 mass % is generally preferable.

<Fe: 0.01 Mass % to 1.40 Mass %>

Fe (iron) is an element that contributes to refinement of crystal grains mainly by forming an Al—Fe based intermetallic compound and provides improved tensile strength. Fe dissolves in Al only by 0.05 mass % at 655° C. and even less at room temperature. Accordingly, the remaining Fe that could not dissolve in Al will be crystallized or precipitated as an intermetallic compound such as Al—Fe, Al—Fe—Si, and Al—Fe—Si—Mg. This intermetallic compound contributes to refinement of crystal grains and provides improved tensile strength. Further, Fe has, also by Fe that has dissolved in Al, an effect of providing an improved tensile strength. In a case where Fe content is less than 0.01 mass %, those effects are insufficient. In a case where Fe content exceeds 1.40 mass %, a wire drawing workability worsens due to coarsening of crystallized materials or precipitates, conductivity also decreases. Therefore, Fe content is 0.01 mass % to 1.40 mass %, and preferably 0.10 mass % to 0.70 mass %, and more preferably 0.105 mass % to 0.45 mass %.

The aluminum alloy wire rod of the present embodiment includes Mg, Si and Fe as essential components, and may further contain at least one selected from a group consisting of Ti and B, and/or at least one selected from a group consisting of Cu, Ag, Au, Mn, Cr, Zr, Hf, V, Sc, Sn, Co and Ni, as necessary.

<Ti: 0.001 Mass % to 0.100 Mass %>

Ti is an element having an effect of refining the structure of an ingot during dissolution casting. In a case where an ingot has a coarse structure, the ingot may crack during casting or a wire break may occur during a wire rod processing step, which is industrially undesirable. In a case where Ti content is less than 0.001 mass %, the aforementioned effect cannot be achieved sufficiently, and in a case where Ti content exceeds 0.100 mass %, the conductivity tends to decrease. Accordingly, the Ti content is 0.001 mass % to 0.100 mass %, preferably 0.005 mass % to 0.050 mass %, and more preferably 0.005 mass % to 0.030 mass %.

<B: 0.001 Mass % to 0.030 Mass %>

Similarly to Ti, B is an element having an effect of refining the structure of an ingot during dissolution casting. In a case where an ingot has a coarse structure, the ingot may crack during casting or a wire break is likely to occur during a wire rod processing step, which is industrially undesirable. In a case where B content is less than 0.001 mass %, the aforementioned effect cannot be achieved sufficiently, and in a case where B content exceeds 0.030 mass %, the conductivity tends to decrease. Accordingly, the B content is 0.001 mass % to 0.030 mass %, preferably 0.001 mass % to 0.020 mass %, and more preferably 0.001 mass % to 0.010 mass %.

To contain at least one of <Cu: 0.01 mass % to 1.00 mass %>, <Ag: 0.01 mass % to 0.50 mass %>, <Au: 0.01 mass % to 0.50 mass %>, <Mn: 0.01 mass % to 1.00 mass %>, <Cr: 0.01 mass % to 1.00 mass %>, and <Zr: 0.01 mass % to 0.50 mass %>, <Hf: 0.01 mass % to 0.50 mass %>, <V: 0.01 mass % to 0.50 mass %>, <Sc: 0.01 mass % to 0.50 mass %>, <Sn: 0.01 mass % to 0.50 mass %>, <Co: 0.01 mass % to 0.50 mass %>, and <Ni: 0.01 mass % to 0.50 mass %>.

Each of Cu, Ag, Au, Mn, Cr, Zr, Hf, V, Sc, Sn, Co and Ni is an element having an effect of refining crystal grains, and Cu, Ag and Au are elements further having an effect of increasing a grain boundary strength by being precipitated at a grain boundary. In a case where at least one of the elements described above is contained by 0.01 mass % or more, the aforementioned effects can be achieved, and a tensile strength and an elongation can be further improved. On the other hand, in a case where any one of Cu, Ag, Au, Mn, Cr, Zr, Hf, V, Sc, Sn, Co and Ni has a content exceeding the upper limit thereof mentioned above, a wire break is likely to occur since a compound containing the said elements coarsens and deteriorates wire drawing workability, and also a conductivity tends to decrease. Therefore, ranges of contents of Cu, Ag, Au, Mn, Cr, Zr, Hf, V, Sc, Sn, Co and Ni are the ranges described above, respectively.

The more the contents of Fe, Ti, B, Cu, Ag, Au, Mn, Cr, Zr, Hf, V, Sc, Sn, Co and Ni, the lower the conductivity tends to be and the more the wire drawing workability tends to deteriorate. Therefore, it is preferable that a sum of the contents of the elements is less than or equal to 2.00 mass %. With the aluminum alloy wire rod of the present disclosure, since Fe is an essential element, the sum of contents of Fe, Ti, B, Cu, Ag, Au, Mn, Cr, Zr, Hf, V, Sc, Sn, Co and Ni is 0.01 mass % to 2.0 mass %. It is further preferable that the sum of contents of these elements is 0.05 mass % to 1.0 mass %. In a case where the above elements are added alone, the compound containing the element tends to coarsen more as the content increases. Since this may degrade wire drawing workability and a wire break is likely to occur, ranges of content of the respective elements are as specified above.

<Balance: Al and Inevitable Impurities>

The balance, i.e., components other than those described above, includes Al (aluminum) and inevitable impurities. Herein, inevitable impurities means impurities contained by an amount which could be contained inevitably during the manufacturing process. Since inevitable impurities could cause a decrease in conductivity depending on a content thereof, it is preferable to suppress the content of the inevitable impurities to some extent considering the decrease in the conductivity. Components that may be inevitable impurities include, for example, Ga, Zn, Bi, and Pb.

In the present embodiment, the longitudinal direction of the aluminum alloy wire rod is taken as a specimen axis to define a crystal orientation. The crystal orientation can represent a direction in which a crystal axis is oriented with respect to the specimen axis.

In the aluminum alloy wire rod of the present embodiment, an area fraction of a region in which an angle formed by the longitudinal direction of the wire rod and a <111> direction of a crystal is within 20° is greater than or equal to 20% and less than or equal to 65%. With such a recrystallization texture, a 0.2% yield strength can be decreased with the tensile strength being high, and flexibility can be provided. The inventors have carried out studies, and found that easiness of cross slip has an influence on the 0.2% yield strength, and that it is better when a region in which an angle formed by a longitudinal direction of the wire rod and a <111> direction of a crystal is within 20°, in which cross slip is less likely to occur, is less. Cross slip is defined as slipping from a certain slip plane to another slip plane.

Here, when an area fraction of a region in which an angle formed by the longitudinal direction of the wire rod and a <111> direction of a crystal is within 20° is greater than 65%, the tensile strength becomes higher, but the 0.2% yield strength also becomes higher, and thus it becomes difficult to provide flexibility. Also, when an area fraction of a region in which an angle formed by the longitudinal direction of the wire rod and a <111> direction of a crystal is within 20° is less than 20%, the tensile strength decreases, and it is not possible to provide a tensile strength that is applicable for a small-sized wire. Preferably, an area fraction of a region in which an angle formed by the longitudinal direction of the wire rod and a <111> direction of a crystal is within 20° is greater than or equal to 30% and less than or equal to 60%.

FIG. 1 is a schematic diagram for explaining an angle formed by the longitudinal direction of the aluminum alloy wire rod and a <111> direction of a crystal is within 20°. As shown in FIG. 1, an angle 13 formed by a longitudinal direction 11 of an aluminum alloy wire rod 15 and a <111> direction 12 of a crystal 14 is the angle formed by the longitudinal direction of the aluminum alloy wire rod and the <111> direction of the crystal according to the present embodiment. The wire rod of the present embodiment is an alloy composed primarily of aluminum, and thus a cubic crystal is considered.

A region in which an angle formed by the longitudinal direction of the wire rod and the <111> direction of a crystal is within 20° includes, when denoted in a direction of a crystal, a crystal for which <111> direction, <121> direction and <122> direction are oriented in the longitudinal direction.

An aluminum alloy wire rod having such crystal orientations can be obtained by controlling production conditions of the aluminum alloy wire rod as described below, and further preferably, by providing an alloy composition as described below.

A description is now made of a preferred manufacturing method of the aluminum alloy wire rod of the present embodiment.

(Manufacturing Method of the Aluminum Alloy Wire Rod of the Present Embodiment)

The aluminum alloy wire rod of the present embodiment can be manufactured with a manufacturing method including sequentially performing each of the processes including [1] melting, [2] casting, [3] hot working (e.g., grooved roller processing), [4] first wire drawing, [5] first heat treatment, [6] second wire drawing, [7] solution heat treatment, and [8] aging heat treatment. Note that a stranding step or a wire resin-coating step may be provided before or after the solution heat treatment or after the aging heat treatment. Hereinafter, steps of [1] to [8] will be described.

[1] Melting

Melting is performed while adjusting the quantities of each component to obtain an aluminum alloy composition described above.

[2] Casting and [3] Hot Working (e.g., Groove Roller Process)

Subsequently, using a Properzi-type continuous casting rolling mill which is an assembly of a casting wheel and a belt, molten metal is cast with a water-cooled mold and continuously rolled to obtain a bar having an appropriate size of, for example, a diameter of 5.0 mmφ to 13.0 mmφ. A cooling rate during casting at this time is, in regard to preventing coarsening of Fe-based crystallized products and preventing a decrease in conductivity due to forced solid solution of Fe, preferably 1° C./s to 20° C./s, but it is not limited thereto. Casting and hot rolling may be performed by billet casting and an extrusion technique.

[4] First Wire Drawing

Subsequently, the surface is stripped and the bar is made into an appropriate size of, for example, 5 mmφ to 12.5 mm mmφ, and wire drawing is performed by cold rolling. The stripping of the surface has an effect of cleaning the surface, but does not need to be performed.

[5] First Heat Treatment

A first heat treatment is applied on the cold-drawn work piece. The heat treatment of the related art is performed at an intermediate process of wire drawing as a softening heat treatment for recovering the flexibility of the drawn wire rod that has been processed and hardened. Whereas, the first heat treatment of the present disclosure differs from the heat treatment of the related art, and performed for forming a desired crystal orientation. Since the heat treatment is performed at high temperature, there may be a case in which solutionizing of a compound of Mg and Si is performed at the same time. The first heat treatment is specifically a heat treatment including heating to a predetermined temperature in a range of 480° C. to 620° C. and thereafter cooling at an average cooling rate of greater than or equal to 10° C./s to a temperature of at least to 200° C. When a predetermined temperature during the first heat treatment temperature is higher than 620° C., an aluminum alloy wire containing the added elements will partly melt, and there is a possibility of a decrease in tensile strength and a bending property, and when the predetermined temperature is lower than 480° C., a desired crystal orientation cannot be obtained, and thus tensile strength and 0.2% yield strength are increased and flexibility becomes poor. Therefore, the predetermined temperature during the heating in the first heat treatment is in a range of 480° C. to 580° C.

A method of performing the first heat treatment may be, for example, batch heat treatment or may be continuous heat treatment such as high-frequency heating, conduction heating, and running heating.

In a case where high-frequency heating and conduction heating are used, a wire rod temperature increases with an elapse of time, since it normally has a structure in which electric current continues flowing through the wire rod. Accordingly, since the wire rod may melt when an electric current continues flowing through, it is necessary to perform heat treatment in an appropriate time range. In a case where running heating is used, since it is an annealing in a short time, the temperature of a running annealing furnace is usually set higher than the wire rod temperature. Since the wire rod may melt with a heat treatment over a long time, it is necessary to perform heat treatment in an appropriate time range. Hereinafter, the heat treatment by each method will be described.

The continuous heat treatment by high-frequency heating is a heat treatment by joule heat generated from the wire rod itself by an induced current by the wire rod continuously passing through a magnetic field caused by a high frequency. Steps of rapid heating and rapid cooling are included, and the wire rod can be heat-treated by controlling the wire rod temperature and the heat treatment time. The cooling is performed after rapid heating by continuously allowing the wire rod to pass through water or in a nitrogen gas atmosphere. This heat treatment time is 0.01 s to 2 s, preferably 0.05 s to 1 s, and more preferably 0.05 s to 0.5 s.

The continuous conducting heat treatment is a heat treatment by joule heat generated from the wire rod itself by allowing an electric current to flow in the-wire rod that continuously passes two electrode wheels. Steps of rapid heating and rapid cooling are included, and the wire rod can be heat-treated by controlling the wire rod temperature and the heat treatment time. The cooling is performed after rapid heating by continuously allowing the wire rod to pass through water, atmosphere or a nitrogen gas atmosphere. This heat treatment time period is 0.01 s to 2 s, preferably 0.05 s to 1 s, and more preferably 0.05 s to 0.5 s.

A continuous running heat treatment is a heat treatment in which the wire rod continuously passes through a heat treatment furnace maintained at a high-temperature. Steps of rapid heating and rapid cooling are included, and the wire rod can be heat-treated by controlling the temperature in the heat treatment furnace and the heat treatment time. The cooling is performed after rapid heating by continuously allowing the wire rod to pass through water, atmosphere or a nitrogen gas atmosphere. This heat treatment time period is 0.5 s to 120 s, preferably 0.5 s to 60 s, and more preferably 0.5 s to 20 s.

The batch heat treatment is a method in which a wire rod is placed in an annealing furnace and heat-treated at a predetermined temperature setting and a setup time. The wire rod itself should be heated at a predetermined temperature for about several tens of seconds, but in industrial application, since a large amount of wire rod is placed, it is preferable to perform for more than 30 minutes to suppress uneven heat treatment on the wire rod. An upper limit of the heat treatment time is not particularly limited as long as there are five or more crystal grains when counted in a radial direction of a wire rod, but in industrial application, since it is likely to obtain five or more crystal grains when counted in a radial direction of a wire rod productivity increases when performed in a short time, heat treatment is performed within ten hours, and preferably within six hours.

In a case where one or both of the wire rod temperature or the heat treatment time are lower than conditions defined above, a desired crystal orientation cannot be obtained, and the tensile strength and the 0.2% yield strength are increased and the flexibility is poor. In a case where one or both of the wire rod temperature and the annealing time are higher than conditions defined above, an aluminum alloy wire containing an additive element partially melts. Thus, the tensile strength and the bending property decrease, and a wire break is likely to occur when handling the wire rod.

The cooling in the first heat treatment at an average cooling rate of greater than or equal to 10° C./s to a temperature of at least 200° C. This is because, at an average cooling rate of less than 10° C./s, precipitates of Mg and Si or the like will be produced during the cooling, and the crystal grains becomes coarse in a subsequent solution heat process step, and thus the tensile strength decreases. Note that the average cooling rate is preferably greater than or equal to 15° C./s, and more preferably greater than or equal to 20° C./s. Since peaks of precipitation temperature zones of Mg and Si are located at 250° C. to 400° C., it is preferable to speed up the cooling rate at least at the said temperature to suppress the precipitation of Mg and Si during the cooling.

[6] Second Wire Drawing

After the first heat treatment, wire drawing is further carried out in a cold processing.

[7] Solution Heat Treatment (Second Heat Treatment)

A solution heat treatment is performed on a cold wire-drawn work piece. The solution heat treatment is a process of dissolving a compound of Mg and Si or the like into aluminum. The solution heat treatment may be performed by batch annealing similarly to the first heat treatment, or may be performed by continuous annealing such as high-frequency heating, conduction heating, and running heating.

The heating temperature of the solution heat treatment is higher than or equal to 460° C. and lower than 580° C. With heating temperature of the solution heat treatment of lower than 460° C., solutionizing is insufficient, and a sufficient precipitation of Mg, Si, or the like cannot be obtained in the subsequent aging heat treatment, and thus the tensile strength decreases. Also, when the aforementioned heating temperature is higher than or equal to 580° C., coarse crystal grains are formed, and thus the tensile strength and the bending property becomes poor. Further, the heating temperature of the solution heat treatment is preferably 480° C. to 560° C.

The cooling in the solution heat treatment is performed at an average cooling rate of greater than or equal to 10° C./s to a temperature of at least 200° C. This is because, at an average cooling rate of less than 10° C./s, precipitates of Mg and Si or the like such as $Mg_2Si$ will be produced during the cooling, and this restricts an effect of improving the tensile strength by the subsequent aging heat treatment step, and there is a tendency that a sufficient tensile strength will not be obtained. Note that the average cooling rate is preferably greater than or equal to 15° C./s, and more preferably greater than or equal to 20° C./s.

Further, in the cooling in the solution heat treatment, it is preferable to perform at an average cooling rate of greater than or equal to 10° C./s to a temperature of at least 250° C., to give an effect of improving the tensile strength by a subsequent aging heat treatment step by suppressing the precipitation of Mg and Si. Since the peaks of precipitation temperature zones of Mg and Si are located at 250° C. to 400° C., it is preferable to speed up the cooling rate at least at the said temperature to suppress the precipitation of Mg and Si during the cooling.

[8] Aging Heat Treatment

Subsequently, an aging heat treatment is applied. The aging heat treatment is conducted to cause aggregates or precipitates of Mg and Si to appear. The heating temperature in the aging heat treatment is preferably 100° C. to 250° C. When the heating temperature is lower than 100° C., it is not possible to cause aggregates or precipitates of Mg and Si to appear sufficiently, and tensile strength and conductivity tend to lack. When the heating temperature is higher than 250° C., due to an increase in the size of the precipitates of Mg and Si, the conductivity increases, but the tensile strength tends to lack. The heating temperature in the aging heat treatment is, preferably 100° C. to 200° C. As for the heating time, the most suitable length of time varies with temperature. In order to improve a tensile strength, the heating time is preferably long when the temperature is low and the heating time is short when the temperature is high. Considering the productivity, a short period of time is preferable, which is preferably 15 hours or less and further preferably 10 hours or less. It is preferable that, the cooling in the aging heat treatment is performed at the fastest possible cooling rate to prevent variation in characteristics. However, in a case where it cannot be cooled fast in a manufacturing process, an aging condition can be set appropriately by taking into account that an amount of precipitates of Mg and Si may vary during the cooling.

A strand diameter of the aluminum alloy wire rod of the present embodiment is not particularly limited and can be determined as appropriate depending on an application, and it is preferably 0.10 mm to 0.50 mm for a fine wire, and 0.50 mm to 1.5 mm for a case of a middle sized wire. The aluminum alloy wire rod of the present embodiment has an advantage in that it can be used as a thin single wire as an aluminum alloy wire, but may also be used as an aluminum alloy stranded wire obtained by stranding a plurality of them together, and among the steps [1] to [8] of the manufacturing method of the present embodiment, after bundling and stranding a plurality of aluminum alloy wires obtained by sequentially performing each of steps [1] to [6], the steps of [7] solution heat treatment and [8] aging heat treatment may be performed.

Also, in the present embodiment, homogenizing heat treatment performed in the prior art may be performed as an additional step after the continuous casting rolling. Since a homogenizing heat treatment can uniformly disperse precipitates (mainly Mg—Si based compound) of the added element, it becomes easy to obtain a uniform crystal structure in the subsequent first heat treatment, and as a result, improvement in tensile strength and bending property can be obtained more stably. The homogenizing heat treatment is preferably performed at a heating temperature of 450° C. to 600° C. and a heating time of 1 to 10 hours, and more preferably 500° C. to 600° C. Also, as for the cooling in the homogenizing heat treatment, a slow cooling at an average cooling rate of 0.1° C./min to 10° C./min is preferable since it becomes easier to obtain a uniform compound.

The aluminum alloy wire rod of the present embodiment can be used as an aluminum alloy wire, or as an aluminum alloy stranded wire obtained by stranding a plurality of aluminum alloy wires, and may also be used as a coated wire having a coating layer at an outer periphery of the aluminum alloy wire or the aluminum alloy stranded wire, and, in addition, it can also be used as a wire harness having a coated wire and a terminal fitted at an end portion of the coated wire, the coating layer being removed from the end portion.

EXAMPLE

The present disclosure will be described in detail based on the following examples. Note that the present disclosure is not limited to examples described below.

Examples and Comparative Examples

Using a Properzi-type continuous casting rolling mill, molten metal containing Mg, Si, Fe and Al, and selectively added Ti, B, Cu, Ag, Au, Mn, Cr, Zr, Hf, V, Sc, Sn, Co and Ni, with contents (mass %) shown in Table 1 is cast with a water-cooled mold and rolled into a bar of approximately 9.5 mm mmφ. A casting cooling rate at this time was approximately 15° C./s. Then, a first wire drawing was performed, and a first heat treatment was performed with conditions indicated in Tables 3-1 and 3-2, and further, a second wire drawing was performed until a wire size of 0.31 mm mmφ was obtained. Then, a solution heat treatment was applied under conditions shown in Tables 3-1 and 3-2. In both of the first heat treatment and the solution heat treatment, in a case of a batch heat treatment, a wire rod temperature was measured with a thermocouple wound around the wire rod. In a case of continuous conducting heat treatment, since measurement at a part where the temperature of the wire rod is the highest is difficult due to the facility, the temperature was measured with a fiber optic radiation thermometer (manufactured by Japan Sensor Corporation) at a position upstream of a portion where the temperature of the wire rod becomes highest, and a maximum temperature was calculated in consideration of joule heat and heat dissipation. In a case of high-frequency heating and consecutive running heat treatment, a wire rod temperature in the vicinity of a heat treatment section outlet was measured. After the solution heat treatment, an aging heat treatment was applied under conditions shown in Tables 3-1 and 3-2 to produce an aluminum alloy wire. Also, Comparative Examples were similarly prepared such that the contents are as shown in Table 2, and the first heat treatment, the solution heat treatment and the aging heat treatment were sequentially carried out under conditions indicated in Table 4 to manufacture an aluminum alloy wire. In Comparative Example 3, a material having a composition corresponding to pure aluminum was used.

For each of the manufactured aluminum alloy wires of the Examples and the Comparative Examples, each characteristic was measured and evaluated by methods shown below.

(A) Area Fraction of a Region in which an Angle Formed by a Longitudinal Direction of the Wire Rod and a <111> Direction of a Crystal is within 20°

A crystal orientation was analyzed using an EBSD method. A cross section perpendicular to a longitudinal direction of the wire rod was taken as an observation surface, and a square with a side length greater than or equal to the diameter of the wire rod was taken as an observation region. The method was carried out under a condition that a crystal orientation of a grain having a size of less than or equal to 1/10 of an average crystal grain size can be identified. Specifically, observation of a crystal orientation was carried out mainly on a sample area of approximately 310 μm in diameter in a cross section perpendicular to the longitudinal direction of the wire rod. An area fraction (%) of a region in which an angle formed by a longitudinal direction of the wire rod and a <111> direction of a crystal is within 20° was calculated as: (Area of a region in which an angle formed by the longitudinal direction of the wire rod and a <111> direction of a crystal is within 20°)/(Area of sample measurement)×100. For observation and analysis, a thermal electron field emission type scanning electron microscope (manufactured by JEOL Ltd., device name "JSM-7001FA") and an analysis software "OIM Analysis" were used with an observation region being 800 μm×500 μm and a scan step (resolution) being 1 μm.

(B) Measurement of Tensile Strength (TS), 0.2% Yield Strength (YS) and YS/TS

In conformity with JIS Z2241, a tensile test was carried out for three materials under test (aluminum alloy wires) each time, and an average value thereof was obtained. As in the existing art, in order that a wire does not break and can be used even if applied to a small sized wire having a small cross-sectional area, a high tensile strength is required, and thus, in the present disclosure, the pass level of the tensile strength was determined as greater than or equal to 200 MP. Since the 0.2% yield strength tends to become higher as the tensile strength becomes higher, a pass level of a ratio (YS/TS) of the 0.2% yield strength (YS) to the tensile strength (TS) was determined as greater than or equal to 0.4. Further, in the present disclosure, a pass level of (YS/TS) was determined as less than or equal to 0.7, such that, even if the tensile strength becomes higher, an increase in the 0.2% yield strength is suppressed and installation to a vehicle can be performed with a minimum force.

(C) 180° Bend Test

A 180° bend test was carried out by winding an aluminum alloy wire on a round rod having a diameter which is ten times the wire diameter of the aluminum alloy wire, and carrying out an observation for cracks occurring in an outer peripheral portion of the bent portion. A microscope (manufactured by Keyence Corporation, device name "VHX-1000") was used for crack observation. A case in which a crack that had occurred in the outer peripheral portion of the bent portion had a length (dimension) of less than or equal to 0.1 mm pass was determined as a pass and indicated as "PASS", and a case in which the length was greater than 0.1 mm was determined as a fail and indicated as "FAIL".

Results of measurement and evaluation of Examples and Comparative Examples with the aforementioned method are shown in Tables 3-1, 3-2 and 4.

TABLE 1

| | | CHEMICAL COMPOSITION (mass %) | | | | | | | | | | | | | | | | | |
|---|---|---|---|---|---|---|---|---|---|---|---|---|---|---|---|---|---|---|---|
| | No. | Mg | Si | Fe | Au | Ag | Cu | Cr | Mn | Zr | Ti | B | Hf | V | Sc | Co | Sn | Ni | Al |
| EXAMPLE | 1 | 0.40 | 0.40 | 0.20 | | | 0.05 | | | | 0.010 | 0.003 | | | | | | 0.10 | Balance |
| | 2 | 0.48 | 0.40 | 0.20 | | | | 0.03 | 0.04 | | 0.010 | 0.003 | | | | | | 0.10 | |
| | 3 | 0.54 | 0.40 | 0.20 | | | | | | | 0.010 | 0.003 | | | | | | 0.10 | |

TABLE 1-continued

| | CHEMICAL COMPOSITION (mass %) | | | | | | | | | | | | | | | | | |
|---|---|---|---|---|---|---|---|---|---|---|---|---|---|---|---|---|---|---|
| No. | Mg | Si | Fe | Au | Ag | Cu | Cr | Mn | Zr | Ti | B | Hf | V | Sc | Co | Sn | Ni | Al |
| 4 | 0.60 | 0.40 | 0.20 | | | | 0.05 | | | 0.010 | 0.003 | | | | | | 0.05 | |
| 5 | 0.34 | 0.50 | 0.20 | | | | | 0.07 | | 0.010 | 0.003 | | | | | | 0.05 | |
| 6 | 0.50 | 0.50 | 0.20 | | | | | | | 0.010 | 0.003 | | | | | | 0.10 | |
| 7 | 0.60 | 0.50 | 0.20 | | | | 0.03 | 0.04 | | 0.020 | 0.003 | | | | | | 0.10 | |
| 8 | 0.34 | 0.60 | 0.20 | | | 0.03 | 0.03 | 0.04 | | 0.010 | 0.003 | | | | | | 0.10 | |
| 9 | 0.40 | 0.60 | 0.20 | | | | 0.03 | 0.04 | | 0.010 | 0.003 | | | | | | 0.05 | |
| 10 | 0.60 | 0.60 | 0.20 | | | 0.03 | | | | 0.010 | 0.003 | | | | | | 0.10 | |
| 11 | 0.72 | 0.60 | 0.20 | | | | 0.03 | 0.04 | | 0.010 | 0.003 | | | | | | 0.10 | |
| 12 | 0.47 | 0.70 | 0.20 | | | | | | | 0.010 | 0.003 | | | | | | 0.10 | |
| 13 | 0.34 | 0.80 | 0.20 | | | | | | | 0.010 | 0.003 | | | | | | 0.10 | |
| 14 | 0.50 | 0.50 | 0.20 | | | | | | 0.05 | 0.010 | 0.003 | | | | | | 0.10 | |
| 15 | 0.50 | 0.50 | 0.01 | | | | | | | 0.010 | 0.003 | 0.05 | | | | | 0.10 | |
| 16 | 0.50 | 0.50 | 0.20 | | | | | | | 0.010 | 0.003 | | 0.05 | | | | 0.10 | |
| 17 | 0.50 | 0.50 | 1.40 | | | | | | | 0.010 | 0.003 | | | 0.05 | | | 0.10 | |
| 18 | 0.50 | 0.50 | 0.20 | | | | | | | 0.010 | 0.003 | | | | 0.10 | | 0.05 | |
| 19 | 0.50 | 0.50 | 1.10 | | | | | | | 0.010 | 0.003 | | | | | 0.05 | 0.10 | |
| 20 | 0.50 | 0.50 | 0.20 | 0.05 | | | | | | 0.010 | 0.003 | | | | | | 0.10 | |
| 21 | 0.50 | 0.50 | 0.10 | | 0.05 | | | | | 0.010 | 0.003 | | | | | | 0.10 | |

TABLE 2

| | | CHEMICAL COMPOSITION (mass %) | | | | | | | | | | | | | | | | | |
|---|---|---|---|---|---|---|---|---|---|---|---|---|---|---|---|---|---|---|---|
| | No. | Mg | Si | Fe | Au | Ag | Cu | Cr | Mn | Zr | Ti | B | Hf | V | Sc | Co | Sn | Ni | Al |
| COM- | 1 | 0.25 | 0.30 | 0.40 | | | 0.42 | | | | | | | | | | | | Balance |
| PARATIVE | 2 | 0.40 | 0.45 | 0.20 | | | 0.15 | | | | | | | | | | | | |
| EXAMPLE | 3 | ***0.00*** | ***0.05*** | 0.20 | | | | | | | | | | | | | | | |

N.B.
1) NUMERICAL VALUES IN BOLD ITALIC IN THE TABLE ARE OUT OF APPROPRIATE RANGE OF THE EXAMPLE

TABLE 3-1

| | | 1st Heat Treatment Condition | | | | 2nd Heat Treatment Condition | | | |
|---|---|---|---|---|---|---|---|---|---|
| | No. | Heating Treatment Method | Heating Temp. (° C.) | Heating Time | Cooling Rate Up To 200° C. (° C./s) | Heating Treatment Method | Heating Temp. (° C.) | Heating Time | Cooling Rate Up To 200° C. (° C./s) |
| EXAMPLE | 1 | Batch Heat Treatment | 500 | 1 h | 30 | Batch Heat Treatment | 540 | 2 h | 30 |
| | 2 | Batch Heat Treatment | 480 | 1 h | 30 | Batch Heat Treatment | 540 | 2 h | 30 |
| | 3 | Running Heat Treatment | 540 | 5 s | ≥100 | Batch Heat Treatment | 540 | 2 h | 30 |
| | 4 | Conduction Heat Treatment | 540 | 0.1 s | ≥100 | Batch Heat Treatment | 540 | 2 h | 30 |
| | 5 | Batch Heat Treatment | 540 | 2 h | 30 | Running Heat Treatment | 500 | 2 s | ≥100 |
| | 6 | Batch Heat Treatment | 540 | 2 h | 30 | Running Heat Treatment | 500 | 5 s | ≥100 |
| | 7 | High Freq. Heat Treatment | 580 | 0.1 s | ≥100 | Running Heat Treatment | 540 | 5 s | ≥100 |
| | 8 | Batch Heat Treatment | 540 | 2 h | 30 | Running Heat Treatment | 540 | 15 s | ≥100 |
| | 9 | Batch Heat Treatment | 540 | 2 h | 30 | Running Heat Treatment | 540 | 10 s | ≥100 |
| | 10 | Batch Heat Treatment | 540 | 2 h | 30 | Batch Heat Treatment | 500 | 2 h | 30 |

TABLE 3-1-continued

| | | Aging Heat Treatment Condition | | Crystal Structure Area Fraction of Region in Which Angle Formed by Longitudinal Direction of Wire Rod and <111> Direction of Crystal is | Evaluation of Performance | | |
|---|---|---|---|---|---|---|---|
| | No. | Temp. (° C.) | Time (h) | Within 20° (%) | Tensile Strength (TS) (MPa) | YS/TS | Crack in 180° Bending Test |
| EXAMPLE | 1 | 150 | 5 | 60 | 265 | 0.58 | PASS |
| | 2 | 170 | 1 | 42 | 247 | 0.49 | PASS |
| | 3 | 130 | 5 | 32 | 248 | 0.56 | PASS |
| | 4 | 130 | 1 | 63 | 224 | 0.47 | PASS |
| | 5 | 150 | 5 | 56 | 258 | 0.58 | PASS |
| | 6 | 130 | 5 | 38 | 253 | 0.51 | PASS |
| | 7 | 150 | 5 | 63 | 265 | 0.54 | PASS |
| | 8 | 100 | 24 | 54 | 251 | 0.54 | PASS |
| | 9 | 130 | 5 | 27 | 234 | 0.53 | PASS |
| | 10 | 170 | 1 | 58 | 276 | 0.56 | PASS |

TABLE 3-2

| | | 1st Heat Treatment Condition | | | | 2nd Heat Treatment Condition | | | |
|---|---|---|---|---|---|---|---|---|---|
| | No. | Heating Treatment Method | Heating Temp. (° C.) | Heating Time | Cooling Rate Up To 200° C. (° C./s) | Heating Treatment Method | Heating Temp. (° C.) | Heating Time | Cooling Rate Up To 200° C. (° C./s) |
| EXAMPLE | 11 | Batch Heat Treatment | 500 | 2 h | 30 | Batch Heat Treatment | 500 | 2 h | 30 |
| | 12 | Batch Heat Treatment | 500 | 2 h | 30 | Batch Heat Treatment | 540 | 2 h | 30 |
| | 13 | Batch Heat Treatment | 540 | 2 h | 30 | Batch Heat Treatment | 580 | 2 h | 30 |
| | 14 | Batch Heat Treatment | 480 | 2 h | 30 | Batch Heat Treatment | 580 | 2 h | 30 |
| | 15 | Batch Heat Treatment | 580 | 2 h | 30 | Batch Heat Treatment | 540 | 2 h | 30 |
| | 16 | Batch Heat Treatment | 540 | 2 h | 30 | Batch Heat Treatment | 540 | 2 h | 30 |
| | 17 | Batch Heat Treatment | 540 | 2 h | 30 | Batch Heat Treatment | 540 | 2 h | 30 |
| | 18 | Batch Heat Treatment | 500 | 2 h | 30 | Batch Heat Treatment | 540 | 2 h | 30 |
| | 19 | Batch Heat Treatment | 500 | 2 h | 30 | Batch Heat Treatment | 540 | 2 h | 30 |
| | 20 | Batch Heat Treatment | 500 | 2 h | 30 | Batch Heat Treatment | 540 | 2 h | 30 |
| | 21 | Batch Heat Treatment | 500 | 2 h | 30 | Batch Heat Treatment | 540 | 2 h | 30 |

| | | Aging Heat Treatment Condition | | Crystal Structure Area Fraction of Region in Which Angle Formed by Longitudinal Direction of Wire Rod and <111> Direction of Crystal is | Evaluation of Performance | | |
|---|---|---|---|---|---|---|---|
| | No. | Temp. (° C.) | Time (h) | Within 20° (%) | Tensile Strength (TS) (MPa) | YS/TS | Crack in 180° Bending Test |
| EXAMPLE | 11 | 200 | 1 | 55 | 278 | 0.65 | PASS |
| | 12 | 100 | 8 | 56 | 235 | 0.54 | PASS |
| | 13 | 130 | 3 | 49 | 265 | 0.51 | PASS |
| | 14 | 130 | 3 | 45 | 246 | 0.49 | PASS |
| | 15 | 130 | 3 | 47 | 230 | 0.50 | PASS |
| | 16 | 150 | 3 | 51 | 261 | 0.56 | PASS |
| | 17 | 150 | 3 | 51 | 278 | 0.51 | PASS |
| | 18 | 150 | 3 | 45 | 255 | 0.53 | PASS |
| | 19 | 150 | 3 | 46 | 275 | 0.54 | PASS |
| | 20 | 150 | 3 | 46 | 260 | 0.53 | PASS |
| | 21 | 170 | 3 | 47 | 256 | 0.59 | PASS |

TABLE 4

| | No. | 1st Heat Treatment Condition: Heating Treatment Method | Heating Temp. (° C.) | Heating Time | Cooling Rate Up To 200° C. (° C./s) | 2nd Heat Treatment Condition: Heating Treatment Method | Heating Temp. (° C.) | Heating Time | Cooling Rate Up To 200° C. (° C./s) |
|---|---|---|---|---|---|---|---|---|---|
| COMPARATIVE EXAMPLE | 1 | Batch Heat Treatment | ***260*** | 4 | ***0.3*** | Conduction Heat Treatment | 490 | 0.11 sec | ≥100 |
| | 2 | Batch Heat Treatment | ***300*** | 1 | ***0.3*** | Conduction Heat Treatment | 560 | 0.36 sec | ≥100 |
| | 3 | Batch Heat Treatment | 540 | 2 h | 30 | Running Heat Treatment | 540 | 15 sec | ≥100 |

| | No. | Aging Heat Treatment Condition: Temp. (° C.) | Time (h) | Crystal Structure Area Fraction of Region in Which Angle Formed by Longitudinal Direction of Wire Rod and <111> Direction of Crystal is Within 20° (%) | Evaluation of Performance: Tensile Strength (TS) (MPa) | YS/TS | Crack in 180° Bending Test |
|---|---|---|---|---|---|---|---|
| COMPARATIVE EXAMPLE | 1 | — | — | ***15*** | ***163*** | ***0.33*** | FAIL |
| | 2 | 175 | 10 | ***85*** | 245 | ***0.89*** | FAIL |
| | 3 | 100 | 24 | 51 | ***95*** | 0.51 | FAIL |

N.B.
1) NUMERICAL VALUES IN BOLD ITALIC IN THE TABLE ARE OUT OF APPROPRIATE RANGE OF THE EXAMPLE
N.B.
2) "YS" IN THE TABLE REPRESENTS 0.2% YIELD STRENGTH (MPa).

From the results in Tables 3 and 4, it can be seen that each of the aluminum alloy wires of Examples 1 to 21 had an area fraction of a region in which an angle formed by a longitudinal direction of the wire rod and a <111> direction of a crystal is within 20° that is within the scope of the present disclosure, and was excellent in both the tensile strength and the flexibility. Also, no crack occurred in the outer peripheral portion in a 180° bend test. Whereas, with Comparative Example 1, an area fraction of a region in which an angle formed by a longitudinal direction of the wire rod and a <111> direction of a crystal is within 20° was smaller than the scope of the present disclosure, and the tensile strength and YS/TS were both poor, and further, a crack occurred in the outer peripheral portion in a 180° bend test. With Comparative Example 2, an area fraction of a region in which an angle formed by a longitudinal direction of the wire rod and a <111> direction of a crystal is within 20° was greater than the scope of the present disclosure, and YS/TS was poor. With Comparative Example 3 (pure aluminum), the tensile strength was poor, and a crack occurred in the outer peripheral portion in a 180° bend test.

The aluminum alloy wire rod of the present disclosure is based on a prerequisite to use an aluminum alloy containing Mg and Si, and an aluminum alloy wire rod used as a wire rod of an electric wiring structure, an aluminum alloy stranded wire, a coated wire, a wire harness, and a method of manufacturing an aluminum alloy wire rod can be provided while maintaining an excellent yield strength and having flexibility, thus it is useful as a conducting wire for a motor, a battery cable, or a harness equipped on a transportation vehicle, and as a wiring structure of an industrial robot. Particularly, since the aluminum alloy wire rod of the present disclosure has a high tensile strength, a wire size thereof can be made smaller than that of the wire of the related art, and it can be appropriately used for a wire routing section requiring a high bending property.

The invention claimed is:

1. An aluminum alloy wire rod having a composition comprising 0.1 mass % to 1.0 mass % Mg; 0.1 mass % to 1.0 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Sn; 0.00 mass % to 0.50 mass % Co; 0.00 mass % to 0.50 mass % Ni; and the balance being Al and inevitable impurities, an area fraction of a region in which an angle formed by a longitudinal direction of the aluminum alloy wire rod and a <111> direction of a crystal is within 20° being greater than or equal to 20% and less than or equal to 65%.

2. The aluminum alloy wire rod according to claim 1, wherein the composition contains at least one element selected from a group consisting of Ti: 0.001 mass % to 0.100 mass % and B: 0.001 mass % to 0.030 mass %.

3. The aluminum alloy wire rod according to claim 1, wherein the composition contains at least one element selected from a group consisting of 0.01 mass % to 1.00 mass % Cu; 0.01 mass % to 0.50 mass % Ag; 0.01 mass % to 0.50 mass % Au; 0.01 mass % to 1.00 mass % Mn; 0.01 mass % to 1.00 mass % Cr; 0.01 mass % to 0.50 mass % Zr; 0.01 mass % to 0.50 mass % Hf; 0.01 mass % to 0.50 mass % V; 0.01 mass % to 0.50 mass % Sc; 0.01 mass % to 0.50 mass % Sn; 0.01 mass % to 0.50 mass % Co; and 0.01 mass % to 0.50 mass % Ni.

4. The aluminum alloy wire rod according to claim 1, wherein a tensile strength is greater than or equal to 200 MPa, and a ratio (YS/TS) of 0.2% yield strength (YS) to the tensile strength (TS) is within a range of 0.4 to 0.7.

5. The aluminum alloy wire rod according to claim 1, wherein the aluminum alloy wire rod has a diameter of 0.10 mm to 0.50 mm.

6. An aluminum alloy stranded wire comprising a plurality of aluminum alloy wire rods which are stranded together, each of plurality of aluminum alloy wire rods having a composition comprising 0.1 mass % to 1.0 mass % Mg; 0.1 mass % to 1.0 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Sn; 0.00 mass % to 0.50 mass % Co; 0.00 mass % to 0.50 mass % Ni; and the balance being Al and inevitable impurities, an area fraction of a region in which an angle formed by a longitudinal direction of the aluminum alloy wire rod and a <111> direction of a crystal is within 20° being greater than or equal to 20% and less than or equal to 65%.

7. A coated wire comprising a coating layer at an outer periphery of one of an aluminum alloy wire rod and an aluminum alloy stranded wire comprising a plurality the aluminum alloy wire rods which are stranded together, the aluminum alloy wire rod having a composition comprising 0.1 mass % to 1.0 mass % Mg; 0.1 mass % to 1.0 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Sn; 0.00 mass % to 0.50 mass % Co; 0.00 mass % to 0.50 mass % Ni; and the balance being Al and inevitable impurities, an area fraction of a region in which an angle formed by a longitudinal direction of the aluminum alloy wire rod and a <111> direction of a crystal is within 20° being greater than or equal to 20% and less than or equal to 65%.

8. A wire harness comprising a coated wire and a terminal fitted at an end portion of the coated wire, the coated wire comprising a coating layer at an outer periphery of one of an aluminum alloy wire rod and an aluminum alloy stranded wire comprising a plurality the aluminum alloy wire rods which are stranded together, the aluminum alloy wire rod having a composition comprising 0.1 mass % to 1.0 mass % Mg; 0.1 mass % to 1.0 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Sn; 0.00 mass % to 0.50 mass % Co; 0.00 mass % to 0.50 mass % Ni; and the balance being Al and inevitable impurities, an area fraction of a region in which an angle formed by a longitudinal direction of the aluminum alloy wire rod and a <111> direction of a crystal is within 20° being greater than or equal to 20% and less than or equal to 65%, the coating layer being removed from the end portion.

9. A method of manufacturing an aluminum alloy wire rod having a composition comprising 0.1 mass % to 1.0 mass % Mg; 0.1 mass % to 1.0 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Sn; 0.00 mass % to 0.50 mass % Co; 0.00 mass % to 0.50 mass % Ni; and the balance being Al and inevitable impurities, an area fraction of a region in which an angle formed by a longitudinal direction of the aluminum alloy wire rod and a <111> direction of a crystal is within 20° being greater than or equal to 20% and less than or equal to 65%, the method comprising:

forming a drawing stock through hot working subsequent to melting and casting, and thereafter carrying out processes at least including a first heat treatment process, a wire drawing process, a solution heat treatment, and an aging heat treatment process in this order, wherein the first heat treatment process includes, after heating to a predetermined temperature within a range of 480° C. to 620° C., cooling at an average cooling rate of greater than or equal to 10° C./s at least to a temperature of 200° C.

* * * * *